United States Patent [19]

Bauer

[11] Patent Number: 4,568,424

[45] Date of Patent: Feb. 4, 1986

[54] METHOD FOR DETERMINING THE END OF DEVOLATILIZING IN A COKE OVEN AND ADJUSTING THE COKE CYCLE BASED THEREON

[75] Inventor: Edmund G. Bauer, Allentown, Pa.

[73] Assignee: Bethlehem Steel Corporation, Bethlehem, Pa.

[21] Appl. No.: 668,539

[22] Filed: Nov. 5, 1984

[51] Int. Cl.[4] ..... C10B 47/10; G01N 21/00

[52] U.S. Cl. ..... 201/1; 201/41; 250/573; 356/436

[58] Field of Search ..... 201/1, 41; 202/151; 356/436; 250/573, 373

[56] References Cited

U.S. PATENT DOCUMENTS

| | | | |
|---|---|---|---|
| 2,839,963 | 6/1958 | Moss et al. | 250/573 |
| 3,544,218 | 12/1970 | Cassidy | 250/573 |
| 3,564,272 | 2/1971 | Tadworth et al. | 250/573 |
| 3,597,084 | 8/1971 | Pagano | 250/573 |
| 4,003,803 | 1/1977 | Schmidt-Balve | 201/1 |
| 4,351,701 | 9/1982 | Bauer | 201/1 |

*Primary Examiner*—Jay H. Woo
*Assistant Examiner*—Joye L. Woodard
*Attorney, Agent, or Firm*—John J. Selko

[57] ABSTRACT

In the operation of a by-product coke oven, in order to provide a coking cycle that meets an aim push time and also includes a coke soaking period of pre-selected length, the method of obtaining a plurality of liquid catch specimens having condensed therein volatiles from samples of gas withdrawn from the oven; determining a light-transmitting value for such liquid catch specimens for the coke devolatilizing period and for the coke soaking period; determining the end of the devolatilizing period based upon the light-transmitting values so determined; and, if necessary, adjusting the heating rate of the coke oven on subsequent coking cycles. Apparatus for obtaining such liquid catch specimens, and for determining such light-transmitting values is disclosed.

7 Claims, 4 Drawing Figures

METHOD FOR DETERMINING THE END OF DEVOLATILIZING IN A COKE OVEN AND ADJUSTING THE COKE CYCLE BASED THEREON

FIELD OF THE INVENTION

This invention relates to the operation of by-product coke oven batteries, and particularly to underfired, regenerative, slot-oven batteries.

BACKGROUND OF THE INVENTION

In the production of coke, the scheduling of the pushing cycles of the coke ovens generally is determined according to the techniques hereinafter described.

The operator begins with a known total number of tons of coke required of the battery per day. Knowing the number of ovens being operated and the total tons of coke produced per oven, per push, the operator determines the aim coke cycle for each oven. Such coke cycle is typically in the range of 18–20 hours for each oven.

Therefore, the operator knows, for a given charge time, that the oven must have a push time a pre-selected number of hours thereafter. With batteries having a large number of ovens, typically 80, very little deviation can be permitted from this pre-selected push time, or else the deviations of all ovens, which are additive, will cause the battery to become severely out of scheduling control. Skilled coke oven operators consider a permitted push time deviation of plus or minus ¼ hour as a practical optimum.

As is known in the art, each coke cycle includes: (1) a charge time, (2) a devolatilizing period immediately following the charge time, (3) a soaking period immediately following the devolatilizing period, and (4) a push time immediately following the soaking period.

For the purpose of this invention, the charge time will be deemed to have occurred upon completion of charging and leveling of coal within the oven.

As is well known, the devolatilizing period of a coke cycle is the period when the volatile constituents of the crushed coal in the oven are vaporized by reason of the heating of the oven. Such volatile by-products are withdrawn from the oven for conventional treatment. For the purposes of this invention, the term volatiles means those volatiles which are readily condensed into a liquid catch medium as disclosed hereinafter.

The length of the devolatilizing period for a given coal mix is a variable that the operator can change, and it depends upon the heating practice used on the oven, i.e., the firing rate of fuel, the reversal cycle on the oven, and the given coal mix.

The coke soaking period takes place upon completion of the devolatilizing period. The purpose of the coke soaking period is to heat the coke, in order to impart the desired physical properties to the finished product. Such properties include coke stability and hardness, as described in ASTM Test Method D-3402. A soaking period which is too short results in coke having low stability. Conversely, a too long soaking period results in the coke cycle being too long, and also is wasteful of heat. For a given coal mix, the operator determines from past experience how long a soaking period should be used to achieve optimum coke properties.

Therefore, in operating a coke oven battery to achieve a given output, with good quality coke, the operator must operate each oven over a coke cycle that has certain generally fixed parameters. These fixed parameters include:

(1) the aim total coke cycle time of the oven, i.e., the time between charge and push (plus or minus permitted deviation), and (2) the total coke soaking time.

In order to change the length of coke cycle time for the purpose of scheduling battery production rate, the only significant variable in the coke cycle available to the operator for flexibility is the length of devolatilizing period. Since the coke soaking period can only begin upon completion of the devolatilizing period, it is critical for the operator to be able to tell when the devolatilizing period ends.

By being able to determine the length of the devolatilizing period for a given coke oven, with a given coal charge, and a given heating practice, the operator can add the pre-selected soaking period, and arrive at a total coke cycle time that can be compared with the aim coke cycle time, and if such coke cycle times are significantly different, the operator can adjust the heating rate of the oven in subsequent coke cycles. If resulting coke properties indicate that the soaking period was too short, this tells the operator that the devolatilizing period in subsequent cycles should be shortened (without changing the fixed, aim push time outside the permitted deviation) by adjustment of the heating rate, in order to lengthen the coke soaking period.

On the other hand, if experience indicates a too long soaking time, this tells the operator that the devolatilizing period must be lengthened (without changing the fixed, aim push time outside the permitted deviation) by adjustment of the heating rate, in order to begin the soaking period later in the cycle.

There is a need, therefore, for a method of determining when the end of devolatilizing occurs, and for adjusting coke oven heating using this information to provide a coke cycle which (1) meets the aim push time within permitted tolerance, and (2) at the same time provides a coke soaking period of pre-selected length.

The method of this invention satisfies such need.

DESCRIPTION OF PREFERRED EMBODIMENT AND BEST MODE

Figure 1:
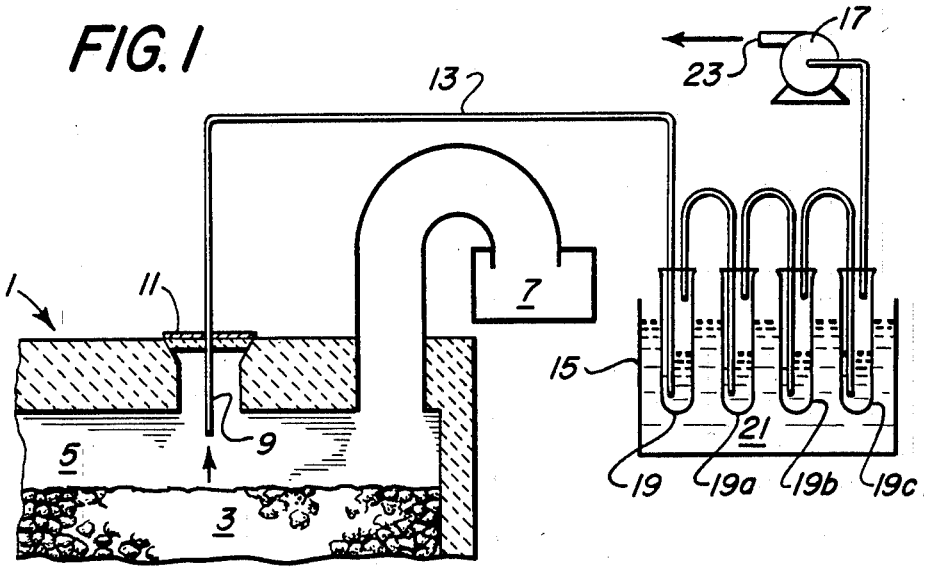
FIG. 1 is a schematic representation of a device for practicing the sampling technique of this invention.

Referring to FIG. 1, a coke oven, shown generally as 1, contains a coal charge 3, with a free space 5 above the coal charge 3 communicating with a collector main 7, as is well known. Other details of the oven and battery are conventional and not shown.

A suitable sampling pipe 9 is inserted into the free space 5 through an opening in charging lid 11. A sample line 13 connects the sampling pipe 9 to a condensing device 15, which, in turn, is connected to a conventional compressor 17. Condensing device 15 includes a plurality of impingers 19, 19A, 19B and 19C connected in series, and which are submerged in a cooling means 21, in this case, an ice bath. Impingers 19, 19A, 19B and 19C are transparent containers.

Inside impingers 19, 19A, 19B and 19C is an essentially colorless liquid catch medium, which can be water or other fluid, such as chloroform. The volume of catch medium inside impingers 19, 19A, 19B and 19C is not critical but I prefer 150 ml in each. Impingers 19, 19A, 19B and 19C are closed at the top to provide a closed system at least until the exit end 23 of Compressor 17.

Compressor 17 continuously draws a sample of gas, containing volatiles therein, from within the oven through the impingers. The volatiles in the gas result from the heating of the crushed coal, as is well known. Such gas bubbles through the liquid catch medium. The gas and liquid catch medium are simultaneously cooled to cause the volatiles to condense and remain in the liquid catch medium. The temperature to which the gas and catch medium are cooled should be low enough to condense substantially all of the volatiles (as defined herein) but not so low as to cause the liquid catch medium to freeze. Four impingers, 19, 19A, 19B and 19C are shown, but any number could be used, so long as substantially all the volatiles are condensed, as evidenced by the last impinger in the train remaining colorless through the sampling period.

Table I lists those compounds that are the volatiles for the purposes of this invention, along with the condensation temperature for each compound.

TABLE I

| Compound | CONDENSATION TEMPERATURE °F. |
|---|---|
| Benzene | 176 |
| Toluene | 231 |
| M + P Xylene | 282 |
| O—Xylene | 292 |
| Mesitylene | 327 |
| Benzofurane (Coumarone) | 345 |
| Indene | 360 |
| Decalin (Trans) | 367 |
| Decalin (CIS) | 383 |
| 3-Methyl Indene | 401 |
| Tetralin | 405 |
| Naphthalene | 424 |
| 2-Methyl Naphthalene | 473 |
| 1-Methyl Naphthalene | 462 |
| Ethyl Naphthalene | 496 |
| 2,3-Dimethyl Naphthalene | 511 |
| Biphenyl | 484 |
| Acenaphthene | 531 |
| Bibenzyl | 509 |
| Fluorene | 567 |
| 2-Methyl Fluorene | 599 |
| Phenanthrene + Anthracene | 643 |
| 9-Methyl Anthracene | 689 |
| Fluoranthene | 739 |
| Pyrene | 741 |
| 1-Methyl Pyrene | 788 |
| Chrysene | 824 |

As is well known, there are volatiles such as methane, hydrogen, carbon monoxide and nitrogen present in the coke oven by-products, but such materials are not condensable at the temperatures utilized for this invention.

I prefer a sample period on the order of 15 minutes, at a gas flow rate of 1 cubic foot per minute, with a liquid catch medium being water. The condensed volatiles cause the liquid catch medium to become dark in color and a very poor transmitter of light.

Each liquid catch specimen has a light-transmitting value determined for it by the following procedure.

The liquid catch specimens from all impingers 19, 19A, 19B and 19C, for a given sampling period, are combined in a transparent container. A white light beam is directed therethrough. A suitable photo electric device measures the amount of light transmitted through the liquid catch specimen. The measurement can be read out in any suitable units. I prefer a light meter, Minolta Camera Model SR7 Model V, set at 1/500 second.

Figure 2:
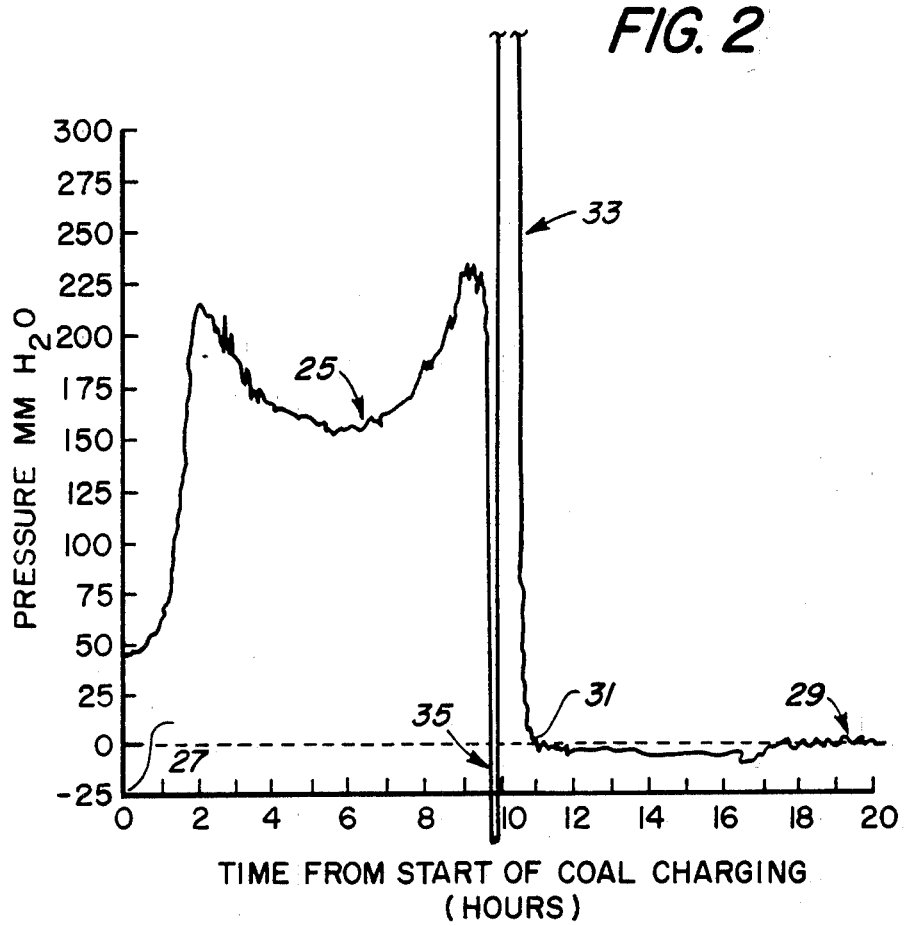
FIG. 2 is a chart depicting gas pressure in the coal-coke mass during a coke cycle showing the devolatilizing period and the end of devolatilizing, a prior art technique.
Figure 3:
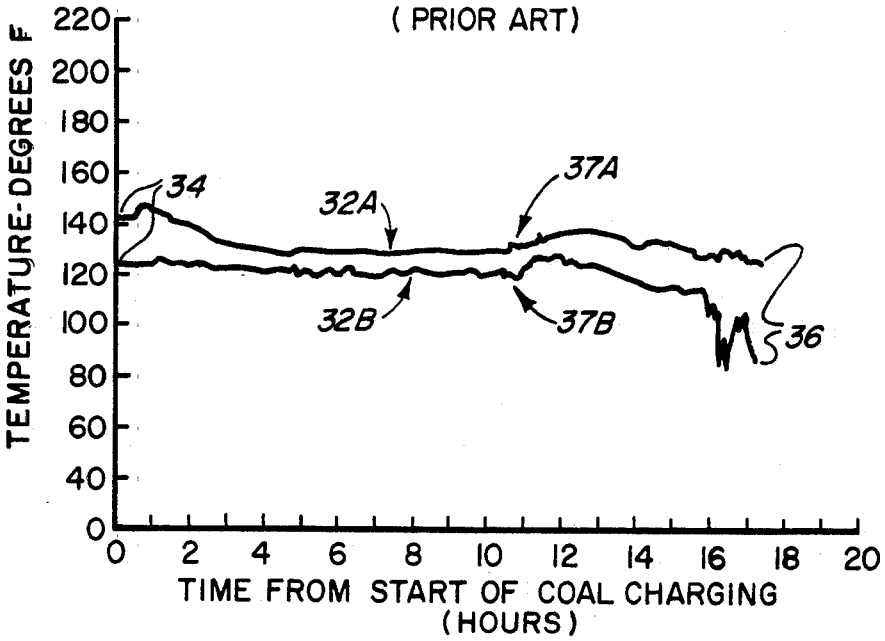
FIG. 3 (PRIOR ART)
FIG. 3 is a chart depicting standpipe temperatures, showing the devolatilizing period and the end of devolatilizing, a prior art technique, for the same coke cycle as FIG. 2.
Figure 4:
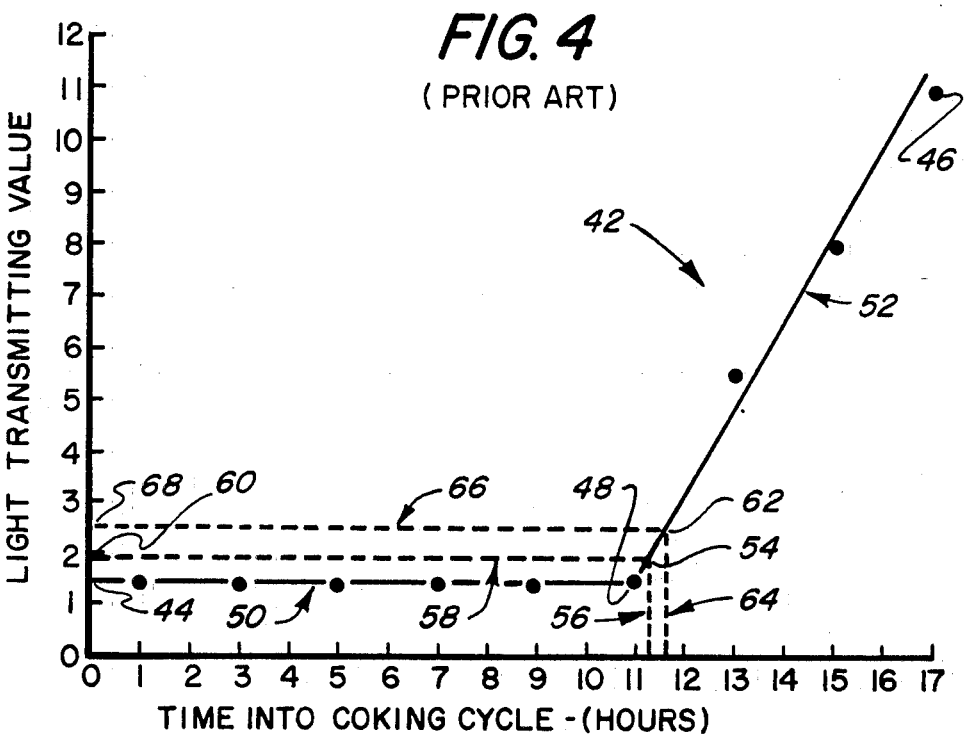
FIG. 4 (PRIOR ART)
FIG. 4 is a chart depicting a light-transmitting value of specimens obtained by this invention, showing the devolatilizing period and the end of devolatilizing for the same coke cycle as FIG. 2.

Referring to FIGS. 2, 3 and 4, I will relate how this method correlates to known prior art methods for determining the end of devolatilization.

FIG. 2 shows a curve 25, obtained by a prior art technique, of the gas pressure in the oven from charge time 27 to push time 29. This technique consisted of inserting a probe into the centerline of the coal-coke mass in the oven, to measure the gas pressure of the coal-coke mass. As is well known, the gas pressure in the oven will approach a zero point when the devolatilizing is complete. For the cycle in question, such devolatizing ceased at hour 11 of the coke cycle, indicated by point 31.

As is well known, the gas pressure exhibits an abrupt "spike" (indicated generally as 33.) immediately before the end of devolatilizing. The negative portion of the curve (indicated generally as 35) immediately before "spike" 33 records a gas pressure drop in the oven, which pressure drop resulted from the operator turning on aspiration steam on the oven for a short period, a practice that is not usual at that portion of the coking cycle. However, such occurrence is of no significance for the purposes of identifying the end of devolatilizing, point 31.

FIG. 3 shows two curves 32A, 32B, obtained by a prior art technique, of standpipe temperatures measured at the coke side and pusher side respectively, from charge time 34 to push time 36. As is well known, the temperature curve will exhibit a slight "jog" when the devolatilizing is complete. Such "jog" 37A, 37B occurred at hour 11, confirming the end of devolatilizing as shown by FIG. 2.

FIG. 4 shows a curve 42 of the light-transmitting value of liquid catch specimens, obtained as described above, as measured for the same coke cycle as FIGS. 2 and 3, from charge time 44 to time 46, shortly prior to push. The light-transmitting values, determined as described above, remained constant from charge time 44 up to hour 11, the end of the devolatilizing period, indicated by point 48. Point 48 corresponds to the end of devolatilizing, as determined by the prior art methods used for FIGS. 2 and 3. The light-transmitting value for the devolatilizing period remains essentially constant, as shown generally on the curve 42 as horizontal solid line 50, thereby establishing a reference light-transmitting value for the devolatilizing period. However, beginning with hour 11, the end of devolatilizing, the light-transmitting values began to change very rapidly 5 over a short period of time, during the soaking period shown generally as 52, beginning at change point 48.

I have discovered that the light-transmitting value of such specimens during the devolatilizing period 50 remains essentially constant, and upon the end of devolatilizing, such light-transmitting value changes at a rate which is essentially linear or, in other words, at a substantially constant rate throughout the coke soaking period. This change point 48 can be used by the operator to begin to measure the coke soaking period in subsequent coke cycles, for control of the oven as hereinafter described.

Method of Operation

Having first determined curve 42 for a first coke cycle, the operator knows the estimated end of devolatilizing period for subsequent coke cycles, for the same coal mix and oven heating practice.

During a subsequent coking cycle, as the estimated end of devolatilizing period (point 48) approaches, the operator begins to obtain liquid catch specimens, and to determine their light-transmitting value. Change point 48 is thereby detected. Using this change point 48, as the time to start the measurement of coke soak, the operator soaks the coke for the pre-selected coke soak time. When the soaking period elapses, the operator compares (1) the total coke cycle time to the end of the soaking period against (2) the aim total coke cycle time (plus or minus permitted deviation) previously set by the operator to achieve the desired level of production. If (1) is equal to (2) within the permitted deviation, no changes are made by the operator in subsequent coking cycles. However, if (1) is less than (2), the operator must lengthen the devolatilizing period on subsequent cycles by slowing the heating rate on the oven. On the other hand, if (1) is longer than (2), the operator must shorten the devolatilizing period on subsequent cycles by increasing the heating rate of the oven.

To increase the heating rate of the oven, and thereby shorten the length of the devolatilizing period, the operator can increase the flow rate of fuel gas to the oven burners. Conversely, to decrease the heating rate of the oven, and thereby extend the length of the devolatilization period, the operator can decrease the flow rate of fuel gas to the oven burners.

Since the operator is relying on change point 48 of light-transmitting value to identify the end of devolatilizing, the operator needs to determine whether or not a given change in light-transmitting value is a result of an equipment sensitivity variation, short-term anomaly in the gas characteristics or, in fact, marks change point 48, the end of devolatilization. This can be accomplished by determining a pre-selected minimum amount of variation in light-transmitting value which must be detected, as compared to the reference light-transmitting value during devolatilizing, determined in a previous coke cycle. When this pre-selected variation is detected, the coke soaking period is begun to be measured. This pre-selected amount is related to the amount of permitted push time deviation the operator is willing to accept as follows:

It has already been determined from a previous coke cycle, curve 42, that the reference light-transmitting value during the devolatilizing period is a given, essentially constant value, in this case, 1.5. Assuming that the operator is aiming for a push time with a permitted deviation of ¼ hour, the point 54 can be located on curve 42 (via dotted line 56) corresponding to ¼ hour past change point 48. Point 54 corresponds (via dotted line 58) to point 60 on the light-transmitting value scale, in this case a value of 1.8. Therefore, when light-transmitting value is equal to or greater than 1.8, the pre-selected variation from the reference value point of 1.5 has occurred and identifies the time to begin measurement of the coke soaking period.

Similarly, an operator could choose as the pre-selected variation from reference value an amount equal to any other reasonably practical given time for permitted push time deviation, for instance ½ hour. Thus, point 62 can be located on curve 42 (via dotted line 64) corresponding to ½ hour past change point 48. Point 62 corresponds (via dotted line 66) to point 68 on the light-transmitting value scale, establishing the pre-selected deviation of light-transmitting value 5 over reference value as 2.4.

The mathematical procedure for relating a pre-selected amount of time in coking cycle to the corresponding required change in light-transmitting value is to multiply the slope of curve 42 in the soaking period 52 times the permitted deviation in aim push time. This product sets the required minimum amount of deviation from reference before a light-transmitting value reading is taken to indicate the end of devolatilization.

I claim:

1. In a process for manufacturing coke in a by-product coke oven battery, the battery having a plurality of ovens; each oven operated over a plurality of coking cycles; each coking cycle having an aim total coke cycle time defined by a charging time and an aim push time, which aim push time has a permitted plus or minus deviation; and between the charging time and aim push time, (1) a devolatilizing period, and (2) a coke soaking period immediately following the devolatilizing period, the method for (1) determining the length of the devolatilizing period and (2) in a subsequent coking cycle, adjusting the heating rate of the oven based upon such length of devolatilizing period, comprising:

(A) in a first coking cycle:

(1) during a devolatilizing period, obtaining a plurality of liquid catch specimens having condensed therein volatiles from gas samples withdrawn from within the coke oven;

(a) determining a reference light-transmitting value of such catch specimens for the devolatilizing period;

(2) during a coke soaking period, obtaining a plurality of liquid catch specimens having condensed therein volatiles from gas samples withdrawn from within the coke oven;

(a) determining the rate of change of light-transmitting values of such liquid catch specimens for the soaking period;

(B) in a second coking cycle:

(1) as the coking cycle approaches an estimated end of the devolatilizing period, obtaining a plurality of liquid catch specimens having condensed therein volatiles from gas samples withdrawn from within the coke oven;

(a) for each liquid catch specimen, determining a light-transmitting value;

(2) beginning the measurement of the soaking period when an individual light-transmitting value of (B)(1)(a) varies from the reference light-transmitting value of (A)(1)(a), by a pre-selected amount;

(3) when a soaking period of pre-selected length elapses, comparing the actual total elapsed coke cycle time to the end of the soaking period versus the aim total coke cycle time required to reach the aim coke push time, plus or minus permitted deviation; and (4) adjusting the heating rate of the oven in a subsequent coking cycle to bring the actual total elapsed coke cycle time to within the aim coke push time, plus or minus permitted deviation.

2. The invention of claim 1 in which the pre-selected amount of light-transmitting value of step (B)(2) is defined by the product of:

(A) the rate of change of light-transmitting value (A)(2-)(a) for the soaking period multiplied by (B) the permitted plus or minus deviation of the aim coke push time.

3. The invention of claim 2 in which the step of obtaining a liquid catch specimen having condensed therein volatiles from gas samples withdrawn from within the coke oven includes:

(A) withdrawing from within the oven a sample of gas containing volatiles therein;

(B) processing such gas sample through a liquid catch medium; and (C) simultaneously cooling such liquid catch medium and such gas to a temperature above the freezing point of the liquid catch medium but low enough to condense the volatiles in such gas into the liquid catch medium.

4. The invention of claim 3 in which the step of determining a light-transmitting value of liquid catch specimens includes:

(A) collecting such liquid catch specimen in a transparent container;

(B) projecting a white light through such liquid catch specimen; and (C) measuring the amount of light transmitted through such liquid catch specimen.

5. The invention of claim 4 in which the liquid catch medium is water or chloroform.

6. In a process for manufacturing coke in a by-product coke oven battery, the battery having a plurality of ovens; each oven operated over a plurality of coking cycles; each coking cycle having an aim total coke cycle time defined by a charging time and an aim push time, which aim push time has a permitted plus or minus deviation; and between the charging time and aim push time, (1) a devolatilizing period of estimated length, which length is controlled by the heating rate of the oven, and (2) a coke soaking period of pre-selected length, immediately following the devolatilizing period, the method for (1) determining the length of the devolatilizing period and (2) adjusting the heating rate of the oven based upon such length of devolatilizing period, comprising:

(A) in a first coking cycle:

(1) during a devolatilizing period, obtaining a plurality of liquid catch specimens having condensed therein volatiles from gas samples withdrawn from within the coke oven;

(a) for each such liquid catch specimen, determining a light-transmitting value;

(b) from the light-transmitting values of (A)(1)(a), determining a reference light-transmitting value for the devolatilizing period;

(2) during a coke soaking period, obtaining a plurality of liquid catch specimens having condensed therein volatiles from gas samples withdrawn from within the coke oven;

(a) for each such liquid catch specimen, determining a light-transmitting value;

(b) from the light-transmitting values of (A)(2)(a), determining the rate of change of light-transmitting values for the soaking period;

(B) in a second coking cycle:

(1) as the coking cycle approaches an estimated end of the devolatilizing period, obtaining a plurality of liquid catch specimens having condensed therein volatiles from gas samples withdrawn from within the coke oven;

(a) for each liquid catch specimen, determining a light-transmitting value;

(2) beginning the measurement of the soaking period when an individual light-transmitting value of value of (B)(1)(a) varies from the reference light-transmitting value of (A)(1)(b), by a pre-selected amount, which pre-selected amount is defined as the product of:

(a) the rate of change of light-transmitting value (A)(2)(b) of the soaking period multiplied by (b) the permitted plus or minus deviation of the aim push time;

(3) when a soaking period of pre-selected length elapses, comparing the actual total elapsed coke cycle time to the end of the soaking period versus the aim total coke cycle time required to reach the aim coke push time, plus or minus permitted deviation; and (4) adjusting the heating rate of the oven in a subsequent coking cycle to bring the actual total elapsed coke cycle time to within the aim coke push time, plus or minus permitted deviation.

7. In a process for manufacturing coke in a by-product coke oven battery, the battery having a plurality of ovens; each oven operated over a plurality of coking cycles; each coking cycle having an aim total coke cycle time defined by a charging time and an aim push time, which aim push time has a permitted plus or minus deviation; and between the charging time and aim push time, (1) a devolatilizing period of estimated length, and (2) a coke soaking period immediately following the devolatilizing period, the method of determining the end of the devolatilizing period comprising:

(A) in a first coking cycle, during a devolatilizing period, obtaining a plurality of liquid catch specimens having condensed therein volatiles from gas samples withdrawn from within the coke oven;

(1) determining a reference light-transmitting value of such catch specimens for the devolatilizing period;

(B) in a second coking cycle, as the coking cycle approaches an estimated end of the devolatilizing period, obtaining a plurality of liquid catch specimens having condensed therein volatiles from gas samples withdrawn from within the coke oven; and (1) determining when an individual light-transmitting value of one of such specimens varies by a pre-selected amount from the reference light-transmitting value of (A)(1).

* * * * *